United States Patent [19]

Thompson et al.

[11] Patent Number: 4,930,695

[45] Date of Patent: Jun. 5, 1990

[54] SUPPORT SYSTEM FOR GUITAR OR LIKE INSTRUMENT

[76] Inventors: Jerry R. Thompson, 8060 Niwot Rd. #263, Longmont, Colo. 80501; Martin W. Peters, 6292 Arapahoe #3, Boulder, Colo. 80303

[21] Appl. No.: 319,564

[22] Filed: Mar. 6, 1989

[51] Int. Cl.[5] ..... A45F 5/00

[52] U.S. Cl. ..... 224/257; 84/327; 224/910; 224/913; 224/258; 224/204

[58] Field of Search ..... 224/910, 913, 202, 204, 224/208, 257, 258, 259, 264, 149, 150; 84/327

[56] References Cited

U.S. PATENT DOCUMENTS

| | | | |
|---|---|---|---|
| 3,334,794 | 8/1967 | Saari et al. | 224/150 |
| 3,498,511 | 3/1970 | Marg | 224/149 |
| 3,595,451 | 7/1971 | Branby | 224/913 X |
| 4,254,901 | 3/1981 | McIntosh | 224/258 |
| 4,279,367 | 7/1981 | Jacobs | 224/257 |
| 4,630,763 | 12/1986 | Friedman | 224/259 |
| 4,656,917 | 4/1987 | Van Halen | 84/327 |

*Primary Examiner*—Ernest G. Cusick

[57] ABSTRACT

A guitar or like instrument harness that supports the weight of an instrument evenly about the shoulders and back of the wearer, while stabilizing the instrument in any position desired by the wearer. The harness utilizes a single strap segment, with structures for attachment to anchor points on the instrument. The strap passes over both shoulders, crossing in the back. The instrument is supported from the loops on either side of the wearer, which are created by the generally "figure 8" type pattern of the strap. One attachment structure is free to slide along the strap, allowing it to maintain a balanced position as the strap shifts to maintain weight distribution along its length.

3 Claims, 2 Drawing Sheets

SUPPORT SYSTEM FOR GUITAR OR LIKE INSTRUMENT

BACKGROUND

1Field of Invention

This invention relates generally to apparatus for supporting an object in front of a person's body, and more particularly to a strap arrangement for supporting and positioning guitars and like musical instruments during playing.

2. Prior Art

Prior art devices for supporting a guitar or like musical instrument generally consist of a single strap that passes over one shoulder of the wearer. Such devices have proven less than ideal. With such devices, the entire weight of the instrument is supported by one shoulder. This type of support often results in discomfort and fatigue. The device is also free to slip across the wearer, requiring the wearer to support the instrument with one hand to maintain proper playing position. These drawbacks have generally been accepted as unavoidable.

SUMMARY OF INVENTION

The present invention is an apparatus for supporting the weight of a guitar or like musical instrument evenly over both shoulders and across the back of the player, while stabilizing the instrument in a player's desired position.

The invention includes: a strap segment passing around both shoulders and twice across the player's back, and structures for suspending the instrument from the strap at two locations on substantially opposite sides of the player's body. Both ends of the strap are secured to a first attachment means, which in turn is secured to the first anchor point on the instrument by the second attachment means. A third attachment means is secured to the second anchor point on the instrument. A fourth attachment means is a loop type device which suspends the third attaching means from the strap while still allowing it to travel freely along the length of the strap.

When in use, the strap resembles a "FIG. 8" shaped loop worn sideways around the back and shoulders. The strap passes from the first attachment means upward over the first shoulder, diagonally down across the back, forward under the arm, up over the second shoulder, diagonally down across the back, and forward under the arm to the first attachment means. The second attachment means connects to the first attachment means at one end, and is adapted to be secured to the first anchor point at its other end. The third attachment means is similarly adapted to be secured to the second anchor point at one end, and the fourth attachment means at its other end. The fourth attachment means loops around the strap without any specific attachment to the strap. The fourth attachment means is free to slide along the length of the strap, and the strap is free to pass through the fourth attachment means without restriction.

The advantages of the present invention result from the pattern of the strap combined with the ability of the strap to slide around the player's body, while at the same time allowing the fourth attachment means to move along the strap to remain in a position to balance the weight distribution of the instrument as transmitted through the two anchor points. The one piece nature of the strap along with the sliding fourth attachment means allows for perpetual and continuous shifting of the entire apparatus to spread the weight of the instrument evenly across the back and shoulders of the player. This action also results in a self-correcting movement which maintains balance as the instrument is moved or shifted, by creating a stress continuum throughout the entire assembly.

DETAILED DESCRIPTION OF THE PREFERRED EMBODIMENT

The present invention relates to supporting a musical instrument in front of a player while distributing the weight of the instrument evenly over both shoulders and across the back, while stabilizing the instrument in a desired position. For illustration purposes, the description that follows will be confined to a guitar. However, it should be understood that the present invention is also suitable for other instruments.

Figure 1:
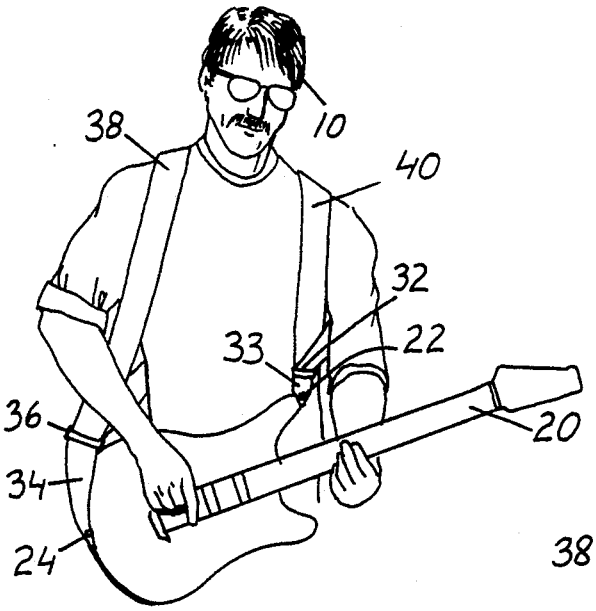
FIG. 1 is a perspective front view of a player using a guitar harness of the present invention.

FIG. 1 is a perspective front view of a player 10 performing on a guitar 20 which is supported by the present invention 40. Guitar 20 is equipped with anchor points 22 and 24 shown at typical locations on substantially opposite sides of the guitar 20. Anchor points 22 and 24 normally assume the form of an outwardly protruding stud having a broadened head.

Figure 2:
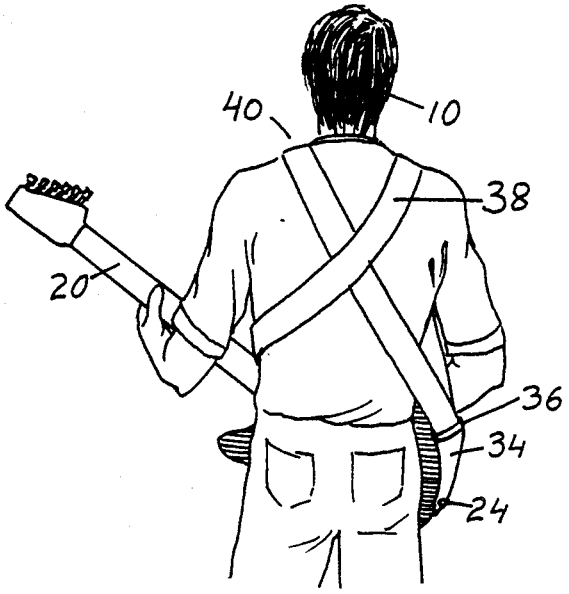
FIG. 2 is a perspective rear view of a player using a guitar harness of the present invention.

FIG. 2 is a perspective rear view of a player 10 performing on a guitar 20 which is supported by the present invention 40.

Figure 3:
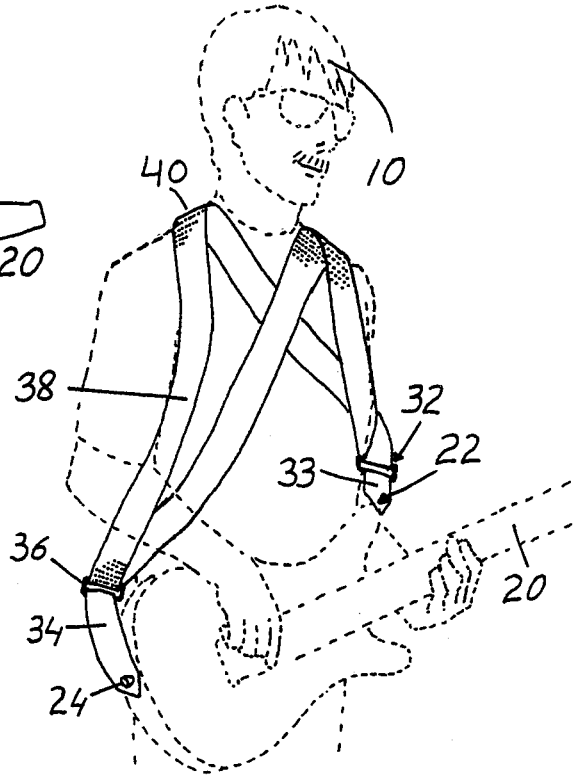
FIG. 3 is a perspective view showing the guitar harness of the present invention in use, with the player and instrument shown in phantom.

FIG. 3 shows the present invention 40 supporting a guitar 20 on player 10, guitar 20 and player 10 being shown in phantom.

FIGS. 1-3 illustrate the relative positioning of the components of the present invention. Strap 38 passes over both shoulders of the player 10, crossing in the back. Both ends of strap 38 are attached to attachment means 32. Attachment means 32 is secured to anchor point 22 by means of attachment means 33. Attachment means 36 loops around strap 38. Attachment means 36 is secured to anchor point 24 by means of attachment means 34.

Strap 38 is fabricated from any suitable substantially nonresilient material approximately one to three inches wide. Attachment means 33 and 34 may be constructed of any relatively flexible material having sufficient tensile strength to support the object to be held. Leather is commonly used for such fittings. Each attachment means 33 and 34 is equiped with a slotted aperture generally smaller than the maximum dimension of the broadened heads of anchor points 22 and 24. Attachment is in a manner similar to that of a button and buttonhole.

Referring to FIGS. 1-3, the first end of strap 38 is secured to attachment means 32. Strap 38 extends up over the shoulder of user 10, diagonally downward across the back, forward under the arm, through attachment means 36, up over the shoulder, diagonally downward across the back, and forward under the arm where the second end of strap 38 is also secured to attachment means 32.

Figure 4:
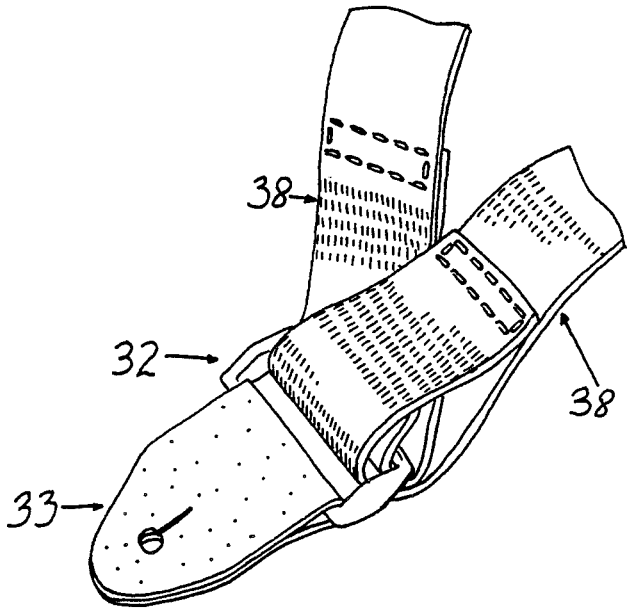
FIG. 4 is a detailed view of the first and second attaching means.

FIG. 4 is a detailed view of both ends of strap 38 secured to attachment means 32 in a typical fashion. Attachment means 33 is shown a secured to attachment means 32, and adapted to be attached to an anchor point on the guitar.

Figure 5:
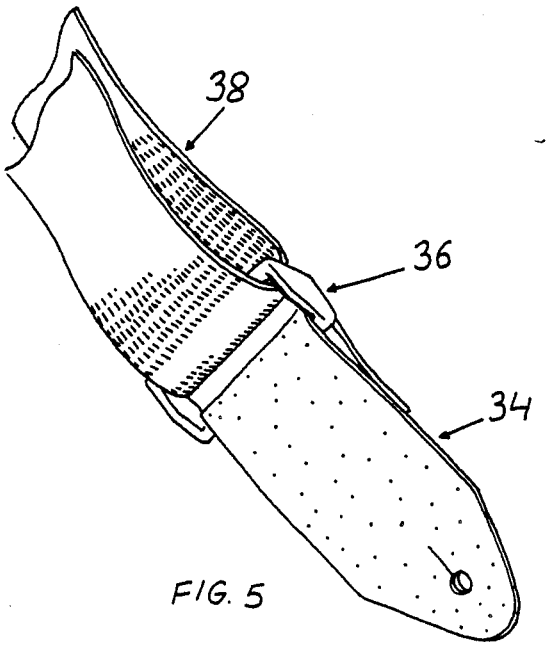
FIG. 5 is a detailed view of the third and fourth attaching means.

FIG. 5 is a detailed view of strap 38 along with attachment means 36 and 34. Attachment means 36 forms a looped member, allowing strap 38 to pass through in either direction without restriction. Attachment means 34 is secured to attachment means 36 and adapted to be attached to an anchor point on the guitar.

When in use, the weight of the guitar 20 is distributed over the length of strap 38 where it contacts the back and shoulders of player 10. If one side of the guitar 20 is moved up or down, the strap 38 slides across the player 10 to allow more of its length to shift towards the lower of anchor points 22 and 24. Once in place, the friction created between strap 38 and player 10 limits the ability of strap 38 to shift, thus holding guitar 20 in the desired position. The ability of strap 38 to slide through attachment means 36 enables the weight supported to cause attachment means 36 to automatically find the proper balance point along the length of strap 38.

It is to be understood that the foregoing description is by way of example only, and not to be taken as limiting the scope of my invention, which is defined by the appended claims.

I claim:

1. A harness for supporting and stabilizing a guitar or banjo in front of a player, said guitar or banjo having first and second spaced anchor points, comprising:

a strap extending from said first anchor point upward over the shoulder proximate the first anchor point, down across the back, forward under the arm opposite the shoulder proximate the first anchor point, up over the shoulder opposite the shoulder proximate the first anchor point, down across the back, forward under the arm proximate the shoulder proximate the first anchor point, and forward to the first anchor point;

means for attaching said second anchor point to said strap at an intermediate point on said strap.

2. The invention of claim 1 wherein the attaching means comprises:

a looped member surrounding said strap, said means being directly attached to said looped member.

3. A device for supporting a musical instrument in front of a player, said musical instrument having first and second spaced anchor points, comprising:

A single strap having two ends;

said strap extending from said first anchor point upward over the shoulder proximate the first anchor point, downward across the back, forward under the arm opposite the shoulder proximate the first anchor point, up over the shoulder opposite the shoulder proximate the first anchor point, downward across the back, forward under the arm proximate the soulder proximate the first anchor point, and forward to the first anchor point;

a first attachment means attached to both ends of said strap;

a second attachment means for attaching said first attachment means to said first anchor point;

a third attachment means for attaching said second anchor point to said strap at an intermediate point thereof;

a fourth attachment means taking the form of a looped member surrounding said strap, said third attachment means being directly attached to said fourth attachment means.

* * * * *